US011633731B2

(12) United States Patent
David

(10) Patent No.: US 11,633,731 B2
(45) Date of Patent: Apr. 25, 2023

(54) HOLDING APPARATUS FOR HOLDING A PIPETTING CONTAINER AT A PIPETTING DEVICE

(71) Applicant: Eppendorf SE, Hamburg (DE)

(72) Inventor: Tobias David, Bargteheide (DE)

(73) Assignee: EPPENDORF SE, Hamburg (DE)

( * ) Notice: Subject to any disclaimer, the term of this patent is extended or adjusted under 35 U.S.C. 154(b) by 729 days.

(21) Appl. No.: 16/575,304

(22) Filed: Sep. 18, 2019

(65) Prior Publication Data

US 2020/0086310 A1 Mar. 19, 2020

(30) Foreign Application Priority Data

Sep. 18, 2018 (EP) ..... 18195162

(51) Int. Cl.
*B01L 3/02* (2006.01)
*B01L 9/00* (2006.01)

(52) U.S. Cl.
CPC ..... *B01L 3/0213* (2013.01); *B01L 9/54* (2013.01); *B01L 2400/0487* (2013.01)

(58) Field of Classification Search
None
See application file for complete search history.

(56) References Cited

U.S. PATENT DOCUMENTS 4,747,316 A 5/1988 Rabinovich
5,406,856 A * 4/1995 Kuhn ..... B01L 3/021 73/864.11

FOREIGN PATENT DOCUMENTS

| | | | |
|---|---|---|---|
| CN | 103285954 | A | 9/2013 |
| CN | 107321412 | A | 11/2017 |
| EP | 0760255 | A1 | 3/1997 |
| EP | 1210978 | A1 | 6/2002 |
| JP | HO6323964 | A | 11/1994 |

* cited by examiner

*Primary Examiner* — Paul S Hyun
(74) *Attorney, Agent, or Firm* — Todd Lorenz

(57) ABSTRACT

The invention relates to a holding apparatus for holding a pipetting container, in particular a serological pipette, at a pipetting apparatus, comprising a tubular connecting section that is configured to hold a tube-shaped end of a pipetting container in a pipetting position by means of a clamping connection, a clamping connection device that is arranged at the connecting section and that comprises a spring device for the establishment of the clamping connection and an air chamber device for releasing the clamping connection by means of a vacuum. Furthermore, the invention relates to a pipetting apparatus with that holding apparatus.

18 Claims, 4 Drawing Sheets

HOLDING APPARATUS FOR HOLDING A PIPETTING CONTAINER AT A PIPETTING DEVICE

Figure 1:
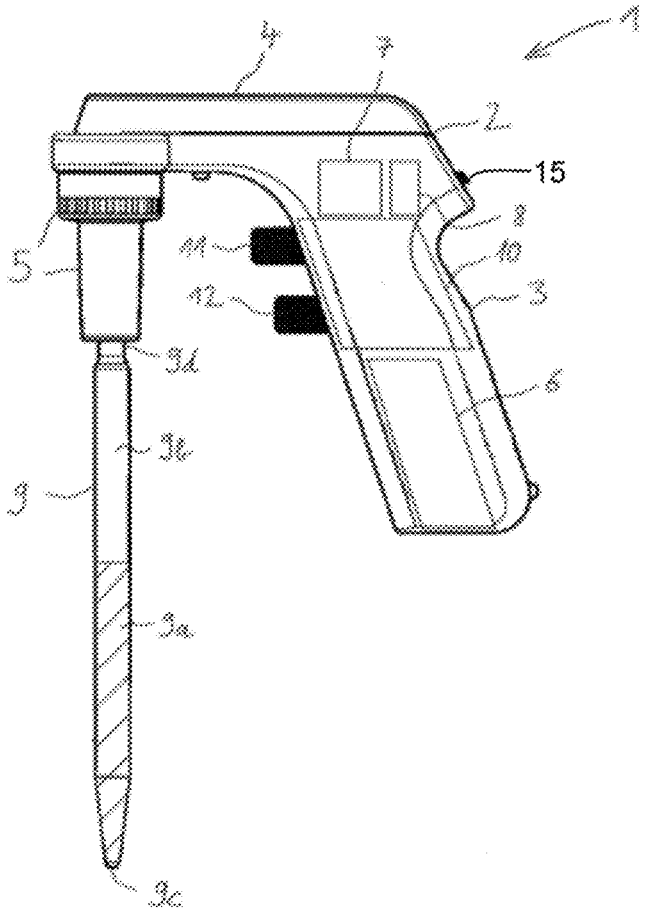

This invention relates to a holding apparatus for holding a pipetting container, in particular a serological pipette, at a pipetting apparatus.

Such pipetting apparatuses are typically used in medical, biological, biochemical, chemical, and other laboratories. In a laboratory, they serve for the transport and transfer of fluid samples, in particular for the precise dosing of the samples. In pipetting apparatuses e.g. fluid samples are aspirated by a partial vacuum into pipetting containers, e.g. serological pipettes or pipette tips, are retained there, and are released from there at the target position.

Among the pipetting apparatuses there are e.g. hand-held pipetting apparatus or automatically controlled pipetting apparatuses, in particular computer-controlled automated pipetting machines. In general, these are air cushion pipetting apparatuses. In such apparatuses an air cushion is provided, the pressure of that air cushion is reduced when taking up the sample into the pipetting container, whereby the sample is aspirated into the pipetting container by the partial vacuum.

Such pipetting apparatuses are, in general, laid out for pipetting fluid samples with volumes in the range of e.g. 0.1 ml up to 100 ml. Pipetting apparatuses are manually or electrically powered devices. Here, the term "pipetting" comprises the uptake of the samples by pressure-controlled aspiration as well as the gravity-driven release of the sample and/or its extrusion by overpressure.

Pipetting apparatuses that serve for the pipetting with serological pipettes are also termed pipet helpers. For pipetting, usually a aspiration-/pressure line is employed, whose activity can be controlled by the operating person through appropriate valves in the casing body. Pipet helpers serve for the manipulation of liquid samples with maximum volumes typically in the range between 1 ml and 100 ml. Depending on the required maximal liquid volume, different serological pipettes are used with the pipet helper. A serological pipette typically comprises a cylindrical container that is elongated along a longitudinal axis, and that exhibits an opening for the exchange of the liquids at the lower end, and at the upper end a tubular end section that is opened towards the upper side. The side wall of the container can exhibit graduation marks that indicate the volume for the dosing, wherein case the pipette is also termed graduated pipette. The aspiration of the liquid into the serological pipette results from the creation of a partial vacuum in the inner part of the serological pipette. The inner part of the serological pipette in a pipetting position, also termed as mounting position, wherein the serological pipette is—typically by slipping—connected with the connecting section of the pipet helper, has a fluidic connection with the pipetting channel of an electrically powered pumping device of the pipet helper. The electrically powered pumping device is in most cases, according to experience, a diaphragm pump that is suitable for pipetting, that can thus generate a partial vacuum as well as a overpressure. Via the pipetting channel the inner compartment can be pressurized with an adjustable partial vacuum or overpressure, or it can be vented, and thus be matched to surrounding pressure. A partial vacuum generated on the inside of a serological pipette is applied above the aspirated liquid sample in the air cushion of the inner compartment in the serological pipette.

Small volumes in the range of e.g. 1 μl up to 1 ml are typically handled with pipetting apparatuses that are termed micropipettes, respectively also piston-stroke pipettes or simply "pipettes". In function of the required maximum liquid volume different pipette tips are used with the micropipette. A pipette tip is typically a disposable item. Typically, a pipette tip exhibits a conical container elongated along the longitudinal axis that exhibits a liquid-exchange opening at the lower end, and at the upper end a conical or tubular end section that is opened towards the upper side. The aspiration of liquids into the pipette tip results from the creation of a partial vacuum in the inner volume of the pipette tip. The inner volume of the pipette tip in the pipetting position, also termed as mounted position, wherein the pipette tip is connected—typically by slipping—to the connecting section of the micropipette, is in fluidic connection with the pipetting channel of the micropipette, which is pressurized by a mechanically and/or electrically moveable cylinder/cylinder piston with a partial vacuum/overpressure. In the case of a mechanically moveable cylinder piston the movement is generated manually by the user, in the case of an electrically moveable cylinder piston an electric energy source is provided for the actuation.

An example of a commercially available, hand-held, electrical pipet helper is the Eppendorf Easypet® 3 of the Eppendorf AG, Hamburg, Germany. An example for a commercially available, hand-held, electrical micropipette is the Eppendorf Xplorer® plus of the Eppendorf AG, Hamburg, Germany. An example for a commercially available, hand-held, mechanical micropipette is the Eppendorf Research® plus of the Eppendorf AG, Hamburg, Germany.

In order to assure a reliable pipetting with pipetting apparatuses, one requirement consists in particular therein, to create a stable connection between a pipetting container and the connecting section of the pipetting apparatus. In general, such a connection is a clamping connection, that is established by a user or a pipetting machine slipping the pipetting container onto the connecting section. The nature of the so-established clamping connection is therefore dependent on the process of slipping. As the user-executed slipping action is dependent on the individual behavior of the user, the correct formation of the required connection between the pipetting container and the connecting section is dependent on the user, which represents a possible error source.

From the document EP1210978A1 a holding device for holding a pipetting container at a pipetting apparatus is known, that has a connecting section that is equipped with an inflatable air chamber that establishes the clamping connection between the connecting section and the tubular end of the pipetting container when it is in the inflated state. The disadvantage thereof is that this arrangement is susceptible to a leakage of the air chamber, which then puts the reliability of the connection in question.

The objective problem underlying the present invention is to provide a holding device for a pipetting apparatus that allows for a reliable connection between a pipetting container and a pipetting apparatus.

The invention solves this task by the pipetting apparatus according to claim 1. Preferred embodiments are in particular subject of the sub-claims.

The holding device according to the present invention has the advantage of the clamping connection being mostly independent of the process of slipping action with which the user or a machine slips the pipetting container onto the connecting section. The establishment of a clamping connection and is release is a separate process, that is controlled independently from the user resp. independently from the process of slipping. By this the connection between the pipetting container and the pipetting apparatus becomes more reliable. Furthermore, the connection established by the holding apparatus according to the present invention between the pipetting container and the pipetting apparatus is independent of a leakage or a malfunctioning of the air chamber device, as the force for the clamping connection is provided by a spring device that operates independently from the air chamber device. Also by this the connection between the pipetting container and the pipetting apparatus becomes more reliable.

In a preferred embodiment of the holding apparatus the clamping connection device is configured for the establishment of a connection between the connecting section and the tubular end of the pipetting container that is air tight in the pipetting position. By this, additional sealants become unnecessary for enabling for a leakage-free pipetting in the pipetting position.

Alternatively and/or additionally, the holding apparatus can comprise a sealing device, e.g. a tubular or annular seal that can in particular be of the shape of a hollow truncated cone, wherein the seal can be reduced step-wise on the inside in axial direction in order to reliably seal sections of the tube of varying diameter, as in practice it is the case for various pipetting containers.

The connecting section is tubular and suitable to be connected with the tubular end of a pipetting container, in particular of a serological pipette. The connecting section extends preferably along a virtual longitudinal axis A so that it is suitable for being connected to a in particular straight, tubular end of a pipetting container that is arranged coaxial to the axis A.

In a first preferred embodiment of the holding apparatus the connecting section is configured to accommodate the tubular end of the pipetting container in its inner compartment in the pipetting position. To this aim the connecting section comprises an accommodating compartment that is open to the outside and that is suitable for accommodating the tubular end of a pipetting container. In particular, the accommodating compartment comprises an opening and an inner compartment with a diameter larger than the outer diameter of the tubular end of the pipetting container. In the acceptance position of the clamping connection device, that clamping connection device is configured so that the tubular end of the pipetting container can be transferred—in particular by a user—into the acceptance compartment.

In a second preferred embodiment of the holding device, the connecting section is configured to engage the tubular end of the pipetting container in the pipetting position. To this aim, the connecting section features an outer diameter that is smaller than the inner diameter of the tubular end of a pipetting container.

Furthermore, the connecting section comprises a pipetting channel that, in the pipetting position, is connected to the inner of the pipetting container and that can be connected or is connected to the pipetting channel of a pipetting apparatus. Then, a partial vacuum applied at the pipetting channel in the pipetting position causes an aspiration of the fluid sample into the pipetting container if its fluid exchange opening that is arranged at the lower end of the pipetting container is immersed into a liquid sample. Accordingly, a pressure in the pipetting channel or a vented condition of the pipetting channel that can be settable for example by means of a temporary connection of the inner of the pipetting channel with the outer atmosphere causes a fluid sample in the pipetting container to be released or bled from the fluid exchange opening.

In the first preferred embodiment of the holding apparatus, the pipetting channel is connected with the acceptance compartment, which can mean that a pipetting channel, in particular a pipe in the form of a flexible tube, of the holding apparatus or of a pipetting apparatus is connected to the acceptance compartment, respectively shaped such that it merges integrally with the acceptance compartment. In the second preferred embodiment of the holding apparatus the pipetting channel is arranged inside the connecting section and ends in the inside of the pipetting container in the pipetting position.

The clamping connection device is arranged at the connecting section and comprises a spring device for establishing the clamping connection and an air chamber device for releasing the clamping connection. By this decoupling of the function for the establishment of the clamping connection and the release of that clamping connection an outstanding reliability can be achieved. The clamping connection device is preferably integrated inside of a base body of the connecting section. The clamping connection device can also be arranged on the outside of the base body of the connecting section. Die clamping connection device can comprise one or more fixation elements that, in the pipetting position, are strained between spring device and the tubular end of the pipetting container and that fixate that pipetting container in particular by means of frictional force in the pipetting position. The at least one fixation element can be constituted by a molded elastomer part that in particular also constitutes the air chamber or at least one wall of the air chamber.

The spring device is configured to exert a spring force, by which the tubular end of the pipetting container is held at the connecting section. This position of the clamping connection device is termed pipetting position.

The air chamber device is configured to be—in particular when starting from the pipetting position—deformed by an partial vacuum applied to the air chamber device, by which the spring device is deformed elastically so that an existing clamping connection is released resp. the tubular end of a pipetting container can be accepted. This open position of the clamping connection device is also termed acceptance position.

The spring device comprises in particular at least one, in particular exactly one spring element. This is preferably non-metallic and consists preferably of a polymeric material, in particular of a elastomeric material. The spring element consisting of a polymeric resp. an elastomeric material comprises preferably one, more or a multitude of voids in order to allow a pressure change that is applied on the outside of the spring element to be effective also on the inside of the elastomeric material. The polymeric resp. elastomeric material is preferably a polymer foam, in particular a polyurethane foam or silicone. The polymer foam is preferably open-pore for allowing an external pressure change to be effective also inside the polymer foam. The spring element is preferably shaped to be arranged in an air chamber of the air chamber device. By this the spring element is strained resp. compressed if a vacuum is applied to the air chamber. Preferably, at least one spring element or exactly one spring element is provided that is ring-shaped or tube-shaped. By this the spring element can be arranged coaxial to the tubular end of the pipetting container, in order to exert a homogeneous radially acting spring force. The spring element can be connected by at least one air chamber device to connecting section. Alternatively or additionally, the spring element can be connected with the connecting section, in particular by a form-fit and/or a force-fit and/or a material connection.

Preferably, the spring device comprises a spring element that effectuates the spring force and that is arranged in the air chamber of the air chamber device. Preferably, the spring device comprises an elastomeric foam part functioning as the spring element or is it composes of this foam part. Preferably, the foam part is tube-shaped and preferably the air chamber is formed for hosting the foam part. Preferably the foam part consists of an open-pore polymer foam, in particular of an polyurethane foam, or it comprises such a material.

Preferably, in the pipetting position the spring element is strained, in particular compressed. Preferably, in the pipetting position, in which the pipetting container is slipped into the connecting section, the spring element is less strained and compressed than in the acceptance position of the clamping connection device, in which no pipetting container is connected to the connecting section. Even though a compressing spring element is preferred, it is also possible that the spring element is configured to be strained by an expansion.

Also, a spring element composed of multiple joints or more than one spring element can be provided, that in particular is arranged coaxial with the connecting section.

If the holding apparatus or a pipetting apparatus comprising it is not connected with a pipetting container, the clamping connection device is preferably arranged in a rest position, which corresponds to the pipetting position. In the rest position no pipetting container is connected to the connecting section, the spring device is maximally relaxed or completely relaxed.

The air chamber device is configured to be deformed in the pipetting position by a partial vacuum applied by the air chamber device, by which the spring device is elastically deformed so that the clamping connection is released.

Preferably, the air chamber device comprises a membrane element that can be elastically deformed. Preferably, the membrane element constitutes a part of an air chamber of the air chamber device or constitutes the air chamber. The membrane element is preferably formed of an elastomeric material or comprises such material, in particular a silicone. Apart from silicone, in particular also a fluoroelastomer (e.g. FKM) can be used. The elastomeric material is preferably a thermoplastic elastomer. Preferably, the membrane element is constituted by a molded elastomer part. The membrane element is preferably essentially tubular, in particular tubular and is preferably arranged coaxially with respect to a longitudinal axis A of the connecting section. The membrane element is preferably releasable or non-releasable—non-releasable intends in particular "not releasable in a non-destructive way"—connected with the connecting section. Preferably, the membrane element is arranged at the connecting section, so that is constitutes with the inner wall or the outer wall of the connecting section at least on air chamber of the air chamber device. In this, the air chamber can additionally be constituted by one or more sealing elements that can be arranged in particular between the connecting section and the membrane element.

The membrane element and/or the molded elastomer part constituting it can also comprise two essentially tubular, in particular tubular, membrane walls that are preferably arranged coaxially in respect to the longitudinal axis A of the connecting section. These membrane walls can comprise outer walls of an air chamber of the air chamber device. The spring device can in particular be arranged in-between these membrane walls.

Preferably, the air chamber is tubular and in particular arranged coaxially with respect to the longitudinal axis A of the connecting section.

Preferably, the air chamber device comprises a connector with which the partial vacuum can be applied to the air chamber device. In particular in this context, the clamping connection device is configured so that the partial vacuum can effectuate a deflection movement of a membrane element and/or a fixation element, by which this deflection movement strains the spring device by its elastic deformation.

The invention relates also to a pipetting apparatus for the pipetting of a fluid sample by aspiration into a pipetting container by means of air with the pipetting pressure applied that comprises exactly one holding apparatus according to the present invention or multiple holding apparatuses according to the present invention. The latter is in particular a multiple-channel-pipetting apparatus, by which multiple fluid samples can be pipetted simultaneously from a multiple-sample container, in particular a microwell plate. To this aim, preferably multiple holding devices are arranged side by side and are preferably connected to the same pipetting channel.

Preferably, the pipetting apparatus comprises a pressure adjustment device, in particular a pumping device for generating the pipetting pressure in a pipetting channel, t that extends through the pipetting apparatus into the connecting section of the holding apparatus, in which the air chamber device of the holding apparatus is connected to an aspiration channel in the pipetting apparatus, in which the partial vacuum that is effective in the air chamber device can be applied. In this, the pipetting apparatus comprises preferably a valve device, with which either a fluidic connection of the aspiration inlet of the pressure adjustment device, in particular the pumping device, with the pipetting channel or a fluidic connection of the aspiration inlet of the pressure adjustment device, in particular the pumping device, with the aspiration channel is established. By using the same pressure adjustment device for the pipetting as well as for generating the partial vacuum in the air chamber device, an efficient design of the pipetting apparatus is achieved. The pumping device comprises at least one pump, preferably exactly one pump, in particular a diaphragm pump. The valve device comprises preferably at least one 3/2 directional control valve, preferably two 3/2 directional control valves.

The pipetting apparatus comprises preferably a first operating element, with which the user controls the pipetting power of the aspiration of the fluid sample and by this the velocity of the sample intake. The pipetting apparatus comprises preferably a second operating element, with which the user controls the pipetting power of the release of the fluid sample and by this the velocity of the sample release. Preferably, the control device is configured so and/or a first 3/2 directional control valve acts together with the pressure adjustment device, the pipetting channel and the aspiration channel so that upon actuation of the first operating element the aspiration channel is closed and the pipetting channel is connected with the pressure adjustment device—e.g. pumping device—, in particular the inlet of the pressure adjustment device, so that a partial vacuum is generated in the pipetting channel, by which the fluid sample can be aspirated into the pipetting container. Preferably, the control device is configured so and/or a second 3/2 directional control valve acts together with the pressure control device, the pipetting channel and the aspiration channel so that upon actuation of the second operating element the aspiration channel is closed and connected with the pressure adjustment device—e.g. the pumping device—, in particular the outlet of the pressure adjustment device, so that the atmospheric pressure or an overpressure is generated in the pipetting channel, with which the fluid sample can be released from the pipetting container.

Preferably, the pipetting apparatus comprises an operating device, with which the user can control the clamping connection device. For the control device, in particular an operating part (switch, push-button, etc.) other than the first and second operating elements is used, which actuates in particular the valves and in activates in particular the pressure adjustment device, in particular the pumping device. For this, preferably a three-position-button is used, with which in particular the three states of the aspiration channel "vacuum", "off", "pressure" can be selected. With the operating part, a vacuum can be generated upon the first actuation—in particular time-controlled. Upon the second actuation of the operating part preferably the reduction of the vacuum is effectuated and by this the pipetting position is established via the spring element.

Preferably, the pipetting apparatus comprises an electronic control device, at least one operating element for activating and/or deactivating the pipetting of the fluid sample by pipetting into the pipetting container, and in particular at least one operating element for releasing the clamping connection of the pipetting container with the holding apparatus, in which preferably the control device is configured for addressing the pumping device and the valve device.

Preferably, the control device is configured so that the fluidic connection between the pressure adjustment device, in particular the pumping device, and the pipetting channel is closed if the fluidic connection between the pumping device and the aspiration channel is open and in particular the pumping device is activated. Preferably, the control device is configured so, that the fluidic connection between the pressure adjustment device, in particular the pumping device, and the aspiration channel is closed if the fluidic connection between the pumping device and the pipetting channel is open and in particular the pumping device is activated. The aspiration channel can be configured to be vented by providing a connection channel to the surrounding atmosphere that—controlled by the control device—is opened and closed. This venting renders possible to reduce the partial vacuum in the air chamber device and that the spring element can built up its clamping force.

The pipetting apparatus, in a preferred embodiment of the invention, can be configured so that the holding apparatus is integrated as an inherent component into the pipetting apparatus. The holding apparatus can therefore be configured as an inherent component of the pipetting apparatus. The pipetting channel of the pipetting apparatus is, in this embodiment, preferably connected fluidicly with a pipetting channel of the holding apparatus and/or an acceptance compartment of the holding apparatus. In particular, the operating part for operating the clamping connection device is a component of the pipetting apparatus, in particular—being operable by a user—integrated into the case of the pipetting apparatus. Preferably, the pipetting apparatus comprises a pressure adjustment device, in particular a pumping device for the generation of the pipetting pressure in a pipetting channel that extends through the pipetting apparatus into the connecting section of the holding apparatus, in which the air chamber device of the holding apparatus is connected in particular with an aspiration channel in the pipetting apparatus, in which the partial vacuum that is effective in the air chamber device can be applied.

In an additional preferred embodiment of the invention the holding apparatus is a modular component that can optionally—in particular by the user—be connected with the pipetting apparatus and can be released from it again. Such a modular construction has the advantage that a single holding apparatus can be used with different pipetting apparatuses. In this case, both the pipetting apparatus as well as the holding apparatus can provide an individual case or an individual base part that supports and/or encloses the other parts of the pipetting apparatus, resp. the holding apparatus. The pipetting channel of the pipetting apparatus can, in this embodiment, be connected fluidicly with a pipetting channel of the holding apparatus and/or an acceptance compartment of the holding apparatus. "to be connected fluidicly" is to be understood as a leak-free tight seal of two air-filled compartments, in particular the pipetting channels.

In particular, the operating part for operating the clamping connection device in this modular embodiment is part of a modular component, in particular—operable by the user—integrated into a case or a base part of the holding apparatus, in which the base part can be constituted by the connecting section. The aspiration channel between a pumping device of the pipetting apparatus that serves for generating/releasing the clamping connection of the clamping connection device of the holding apparatus can preferably be connected fluidicly with another aspiration channel of the holding apparatus, in which the other aspiration channel of the holding apparatus serves for generating/releasing the clamping connection of the clamping connection device of the holding apparatus. It is also possible that the pipetting channel of the pipetting apparatus is connectable with an aspiration channel of the holding apparatus. The holding apparatus can comprise a valve—that in particular can be controlled by the control device or manually by the user—, with which selectively the aspiration channel of the holding apparatus and/or the pipetting channel of the holding apparatus can be connected fluidicly to the pipetting channel of the pipetting apparatus. By means of the later provision the modular component can be operated also with pipetting apparatuses that do not comprise an own aspiration channel for addressing the air chamber device, and furthermore the modular component can also be operated without an own pumping device. In particular as a modular component, the holding apparatus can comprise also an electrical energy source, in particular a battery resp. a secondary battery as well as preferably an electronic control device.

It is also possible and preferred that the holding apparatus comprises, in its modular embodiment, a (own) pressure adjustment device, in particular a pumping device for generating the pipetting pressure in an aspiration channel of the holding apparatus that is connected fluidicly with the air chamber device of the holding apparatus and through which in particular the partial vacuum effective in the air chamber device can be applied. In this embodiment, the operating part can also part of the pipetting apparatus. In this variant it is necessary to connect an aspiration channel of the pipetting device with an additional aspiration channel of the holding apparatus.

In the case of the modular embodiment of the holding apparatus the invention relates in particular to a system that a) comprises a pipetting apparatus for the pipetting of a fluid sample by aspiration into a pipetting container by means of air under the pipetting pressure and
b) a holding apparatus that can be optionally connected to the pipetting apparatus and be released again, c) and in particular also a pipetting container that can be connected to the holding apparatus.

The pipetting container that can be connected to the connecting section is preferably a serological pipette, but it can also be a conventional or a specially adapted pipette tip. Such pipetting containers are in particular disposable products and consist preferably of plastic.

The diameter of conventional serological pipette is standardized and varies depending on size, producer and material (glass or polymer).

The outer diameters of the end sections of serological pipettes that are to be connected with the connecting section varies typically in a ranges from 4.5 to 9.0 mm, depending on the producer, as an example, the outer diameters ensue in relation to the maximal intake-volume of the serological pipette as follows:

1 ml 4.8 mm
2 ml 6.5 mm
5 ml 8.1 mm
10 ml 7.8 mm
25 ml 9.0 mm
50 ml 8.3 mm
100 ml 9.0 mm

The invention also relates to an automated laboratory machine for the automatized handling of a multitude of fluid samples that comprises a pipetting apparatus according to the present invention and that automatically, in particular controlled by a computer program, controls the clamping connection device of the holding apparatus of the pipetting apparatus, in particular the process of inducing the acceptance position and/or the pipetting position. The pipetting apparatus is in this in particular a multi-channel-pipetting apparatus. Such automated laboratory machine are also termed as "liquid handling"-automated machines. An example for such an automated laboratory machine that can be equipped with a holding apparatus according to the present invention is the liquid handling system of the Eppendorf series epMotion®, for example epMotion® 5070 or epMotion® 5075I of the producer Eppendorf AG, Hamburg, Germany.

The invention relates also to a system that comprises a holding apparatus according to the present invention or a pipetting apparatus comprising that holding apparatus and a pipetting container that can be connected in the acceptance position of the clamping connection device of the holding apparatus to the connecting section, in order to establish the pipetting position.

Further preferred embodiments and features of the holding apparatus and/or pipetting apparatus according to the present invention ensue from the following description of the embodiment examples in connection with the figures and their description. Equal components of the embodiment examples are essentially labeled with the same labels, if it is not described differently or can be inferred differently from the context. In the drawings:

FIG. 1 displays a schematic lateral view of a first embodiment example of the pipetting apparatus according to the present invention that comprises an exemplary holding apparatus according to the present invention.

Figure 2A:
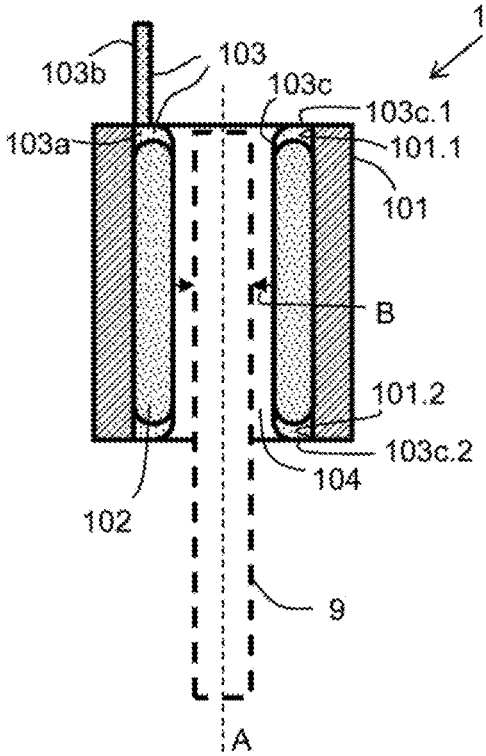

FIG. 2*a* displays in a schematic lateral cross section an embodiment example of the holding apparatus according to the present invention, in an acceptance position of the clamping connection device.

Figure 2B:
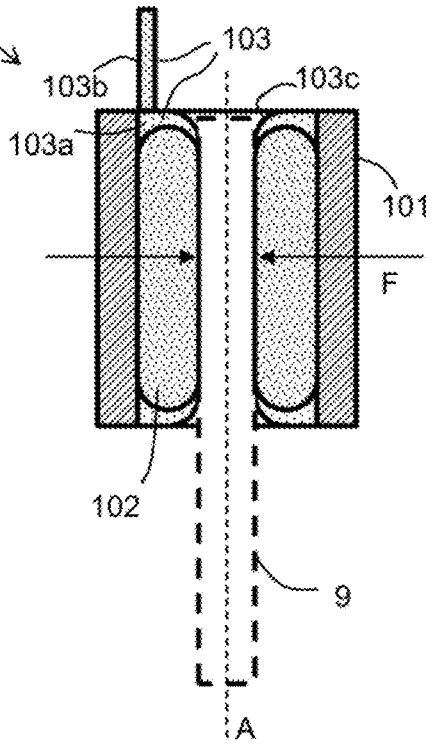

FIG. 2*b* displays in a schematic lateral cross section the holding apparatus of FIG. 2*a*, in a pipetting position of the clamping connection device.

Figure 3A:
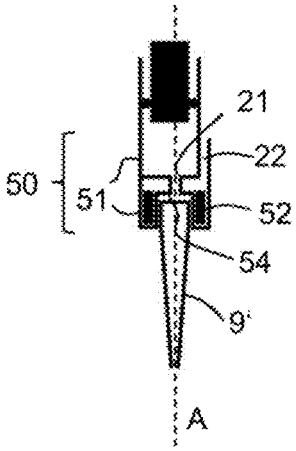

FIG. 3*a* displays in a schematic lateral view a holding apparatus according to the present invention according to a first embodiment example that in principle corresponds to the embodiment example of FIG. 2*a*, 2*b*.

Figure 3B:
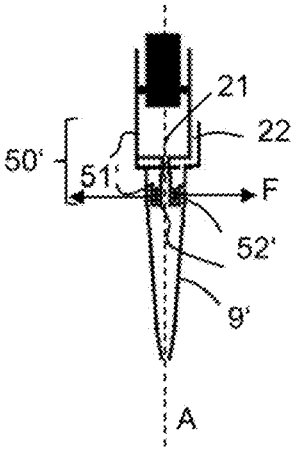

FIG. 3*b* displays in a schematic lateral view a holding apparatus according to the present invention according to a second preferred embodiment example.

Figure 4:
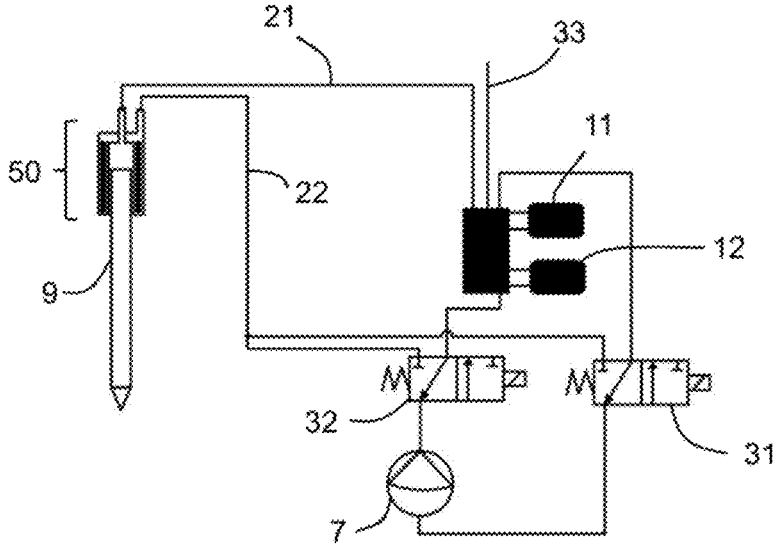

FIG. 4 displays a circuit diagram of the fluid-technical circuit in which the clamping connection device of the holding apparatus from FIG. 3*a*, the valve device of the pipetting apparatus from FIG. 1 and two 3/2 directional control valve are connected to a pumping device of the pipetting apparatus.

Figure 5:
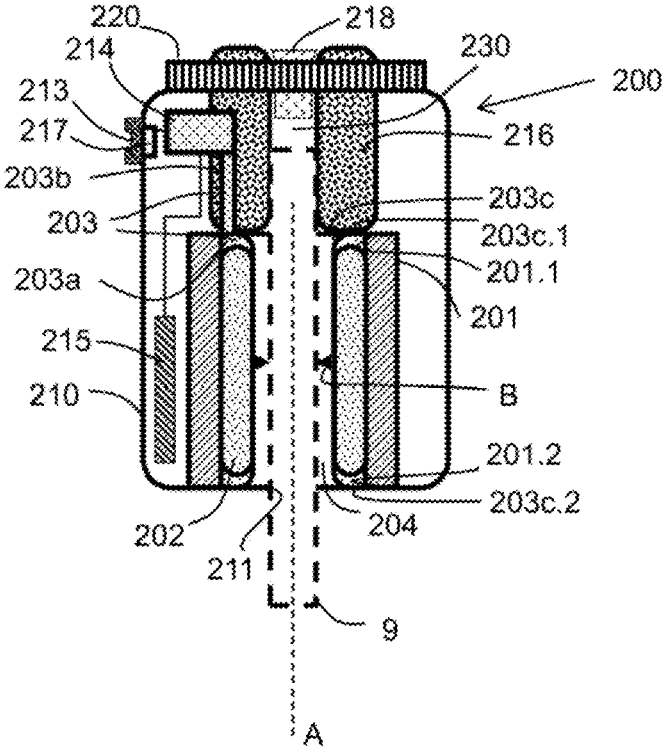

FIG. 5 displays a schematic lateral view of the holding apparatus according to the present invention according to an embodiment example.

Figure 6:
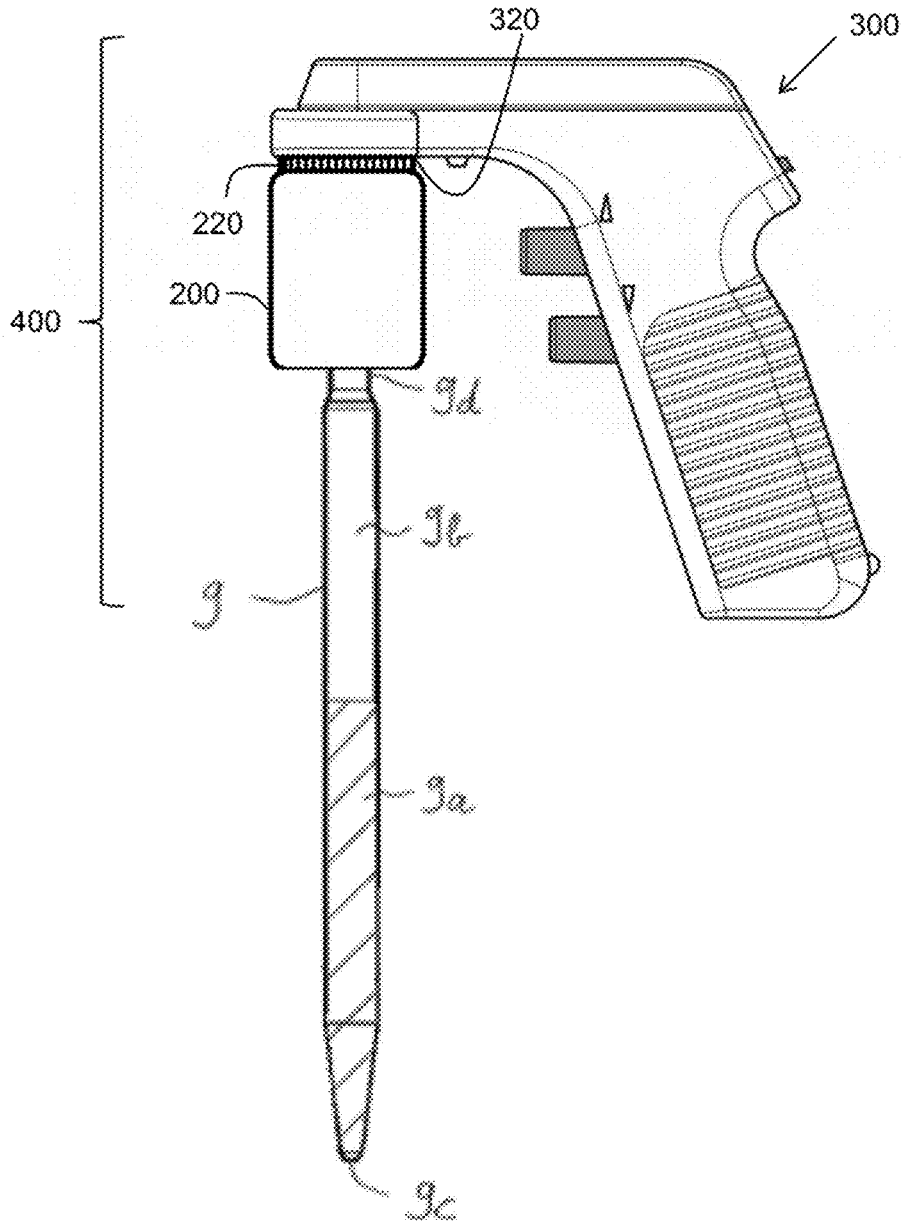

FIG. 6 displays a schematic lateral view of a pipetting apparatus that comprises the holding apparatus from FIG. 5.

FIG. 1 displays a schematic lateral view of a first embodiment example of the pipetting apparatus 1 that is equipped with a holding apparatus 5 according to the present invention. The pipetting apparatus is a single-handedly manually operable device that is employed in particular in chemical, biological and/or medical laboratories. It comprises a case 2 with a handle section 3 and a support section 4, at the end of which pointing downwards the holding apparatus 5 is located. The pipetting apparatus comprises a battery 6 and, powered by this, a diaphragm pump 7. The diaphragm pump 7 generates on the one hand the partial vacuum/pressure for pipetting the fluid sample 9*a*, on the other hand a partial vacuum/pressure for operating the air chamber device of the clamping connection device of the holding apparatus 5, as will be explained in the following.

The pipetting container 9 is a serological pipette. Its tubular end 9*d* is connected to the connecting section of the holding apparatus 5 by means of the clamping connection device of the holding apparatus 5.

Here, the holding apparatus 5 is configured as an integral part of a pipetting apparatus. It can also be configured simply as a modular component that can be connected optionally—in particular by a user—with the pipetting apparatus and be released again from it. In the case of a modular construction the pipetting channel of a pipetting apparatus and the pipetting channel of a holding apparatus can be connected divisibly, and also the aspiration channel of the pipetting apparatus can be connected divisibly with a corresponding aspiration channel.

FIG. 2*a* displays in a schematic lateral cross section a holding apparatus 100, in an acceptance position of the clamping connection device, in which a tubular end of a pipetting container 9, in particular of a serological pipette, can be accepted by the holding apparatus by placing the tubular end in the acceptance compartment 104 of the connecting section 101 and subsequently actuating the clamping connection device 102, 103 in order to establish the pipetting position. The holding apparatus can be implemented as the holding apparatus 5 in FIG. 1. FIG. 2*b* displays a holding apparatus 100 in the pipetting position of the clamping connection device, in which the tubular end of the pipetting container 9, in particular a serological pipette, is held in a power-matched manner by the holding apparatus.

The holding apparatus 100 for holding a pipetting container, in particular a serological pipette, comprises: a tubular connecting section 101 that is configured to hold the straight tubular end of a pipetting container in a pipetting position by means of a clamping connection on the pipetting apparatus, a clamping connection device 102, 103 that is arranged on the connecting section 101 and that comprises a spring device 102 for establishing the clamping connection and an air chamber device for releasing the clamping connection, in which the spring device 102 is configured to exert force effective radially inward and perpendicularly to the longitudinal axis A, by which the tubular end of the pipetting container is held in a force-matched manner at the connecting section in the pipetting position. The air chamber 103*a* of the air chamber device 103 is configured to be deformed in the pipetting position by partial vacuum applied to the air chamber 103*a* via the inlet 103*b*, by which the spring device 102 is deformed elastically so that the clamping connection is released.

The connecting section 101 is configured to accept in the pipetting position the tubular end of the pipetting container in its inner compartment. The connecting section can be a tubular polymer part that can be connected to the pipetting apparatus 1 or that can be part of a pipetting apparatus. In the embodiment example of FIG. 2*a, b* the connecting section 101 comprises a cylindrical acceptance compartment 104, in which essentially the clamping connection device 102, 103 is arranged.

The air chamber device 103 comprises an elastically deformable membrane element 103*c*. This is essentially a cylindrical molded elastomer part that is arranged coaxially to the axis A with the holding section 101. The upper end 103*c*.1 of the membrane element 103*c* is connected with the upper end 101.1 of the holding section 101, in particular the acceptance compartment 104, and the lower end 103*c*.2 of the membrane element 103*c* is connected with the lower end 101.2 of the holding section 101, in particular the acceptance compartment 104. As the membrane 103*c* is connected with the holding section 101, an air tight air chamber 103*a* is formed between the membrane 103*c* and the holding section 101, that can be pressurized with a partial vacuum via the closable inlet 103*b*, that can be generated by a pumping device (not shown) of the holding apparatus that is connected to the inlet 103*b*. The membrane can be connected to the holding section 101, by reverting the cylindrical end 103*c*.1, 103*c*.2 each over the end 101.1 and 101.2 and can be held in this position by an elastic tension. The membrane can also be connected in a material-matched manner with the holding apparatus 101, in particular by a glued and/or welded connection. The membrane element 103*c* constitutes together with the holding section the air chamber 103*a*.

The air chamber device 103 comprises an inlet 103*b*, with which the partial vacuum can be applied to the air chamber device. In this, the clamping connection device is configured so that a radially inward pointing deflection movement B of the membrane element can be effectuated by the partial vacuum, which strains the spring device 102 by its elastic deformation.

By venting the air chamber 103*a* the spring device relaxes partially from its elastically compressed state and generates the force F if the membrane of the membrane element 103*c* is pushed radially inwards and meets the tubular end of the pipetting container. In this state (pipetting position) the spring element is still partially elastically compressed. The membrane acts as a fixation element for fixing the pipetting container at the holding apparatus. The force F results in an effective axial frictional force that holds the pipetting container against a displacement along the axis A at the holding apparatus.

The spring device 102 comprises a spring element that effectuates the spring force F and that is arranged in the air chamber 103*a* of the air chamber device 103. Here, the spring element is essentially a tube-shaped foam part of open-pore polyurethane foam. This part is arranged between the membrane and the inside of the holding section 101.

The spring element 102 in the acceptance position in FIG. 2*a* is strained resp. compressed. In the pipetting position, in which the pipetting container is slipped onto the connecting section, the spring element is partially strained, resp. less compressed than in the acceptance position.

FIG. 3*a* displays in a schematic lateral view the holding apparatus 50 according to on first preferred embodiment example. The connecting section 51 of the holding apparatus 50 is configured to accept in the pipetting position the tubular end of the pipetting container, here a pipette tip 9', in its inner compartment, by having the tubular end engage the acceptance compartment 54 of the connecting section 51. The clamping connection device 52 that is arranged in the acceptance compartment is "deactivated" by applying the vacuum via the aspiration channel 22, resp. "activated" by venting via the aspiration channel 22, as it has been explained in the example of the FIGS. 2*a*, 2*c*. Pipetting is carried out via the pipetting channel 21.

FIG. 3*b* displays in a schematic lateral view a holding apparatus according to a second preferred embodiment example. The connecting section 51' of the holding apparatus 50' is configured to reach in the pipetting position into the tubular end of the pipetting container, here a pipette tip 9'. The clamping connection device arranged externally at the lower end of the connecting section is "deactivated" by applying the vacuum via the aspiration channel 22, resp. "activated" by venting via the aspiration channel 22. The deactivation generates, by means of the pumping power, a vacuum in the air chamber device that compresses the spring device. By this the air chamber device is deformed, in particular a membrane is pulled radially inwards, so that the connecting section can accept the tubular open end of the pipetting container, by the connecting section being able to engage the open tubular end (acceptance position). The "activation" of the clamping connection device 52' occurs by venting the air chamber device, by enabling the spring device to partially decompress in order to expand radially outwards and to press the membrane against the inner wall of the tubular end of the pipetting container. Pipetting is carried out via the pipetting channel 21.

The pipetting apparatus displayed in FIG. 1 serves for the pipetting of a fluid sample (9*a*) by aspiration into a pipetting container (9) by means of air under a pipetting pressure (9*b*), that comprises in particular a holding apparatus 100.

The pipetting apparatus comprises a pumping device for generating the pipetting pressure in a pipetting channel that extends through the pipetting apparatus into the connecting section 101 of the holding apparatus, in which the air chamber device of the holding apparatus is connected with an aspiration channel in the pipetting apparatus, in which the partial vacuum that is effective in the air chamber device can be applied, in which the pipetting apparatus comprises a valve device, by the means of which either a fluidic connection of the aspiration inlet of the pumping device with the pipetting channel or a fluidic connection of the aspiration inlet of the pumping device with the aspiration channel can be established.

The pipetting apparatus comprises an electronic control device 8, two operating elements 11, 12 for activating and/or deactivating the pipetting of the fluid sample by aspiration (11) into the pipetting container or for the release (12) of the fluid sample from the pipetting container by generating an overpressure. The pipetting apparatus comprises an operating element 15 for establishing the acceptance position resp. for releasing the clamping connection of the pipetting container with the holding apparatus, in which the control device is configured to address the pump device 7 and the valve device 10.

FIG. 4 displays a circuit diagram of the fluid-technical circuit in which the clamping connection device of the holding apparatus 50, the valve device 10 and the valves 31, 32 are connected with the diaphragm pump 7. Here, the valves 31, 32 are each 3/2 directional control valves.

The control device 8 is configured such that the fluidic connection between the pumping device and the pipetting channel 21 is closes if the fluidic connection between the pumping device and the aspiration channel 22 is open and the pumping device 7 is activated, and that the fluidic connection between the pumping device 7 and the aspiration channel 22 is closed if the fluidic connection between the pumping device 7 and the pipetting channel 21 is open and the pumping device 7 is activated.

The pipetting apparatus 1 comprises a first operating element 11, with which the user controls the pipetting power of the aspiration of the fluid sample and thus the velocity of the sample intake. The pipetting apparatus comprises a second operating element 12 with which the user controls the pipetting power of the release of the fluid sample and thus the velocity of the sample release. The control device 8 is configured such and a first 3/2 directional control 31 acts together with the pressure adjustment device 7, the pipetting channel 21, the aspiration channel 22 and a venting channel 33 that is open to the surrounding in such a way that, upon the actuation of the first operating element 31, the aspiration channel 22 is closed and the pipetting channel 21 is connected with the pressure adjustment device—e.g. pumping device 7—, in particular the inlet of the pumping device 7, that a partial vacuum is generated in the pipetting channel 21, with which the fluid sample can be aspirated into the pipetting container 9. Furthermore, the control device 8 is configured such and a second 3/2 directional control valve acts together with the pressure adjustment device 7, the pipetting channel 21, and the aspiration channel 22 in such a way that, upon actuation of the operating element 12, the aspiration channel 22 is closed and connected with the pressure adjustment device—e.g. the pumping device 7—, in particular the outlet of the pumping device, that atmospheric pressure or overpressure is applied in the pipetting channel 21, with which the fluid sample can be release from the pipetting container 9.

The pipetting apparatus comprises a control device, with which the user can control the clamping connection device 52, (102, 103) of the holding apparatus 50, 100. For the control device, in particular in addition to the first 11 and second operating element 12, an operating element 15 (switch, push button, etc.) is employed that switches in particular the valves 31, 32 and that in particular activates the pressure adjustment device 7, in particular the pumping device. The operating element 15 is a three-position-button, with which in particular the three states of the aspiration channel 22 "vacuum", "off", "pressure" can be selected. Via the operating element 15, a vacuum can be built up upon the first actuation—in particular time-controlled. Upon the second actuation of the operating element 15, preferably the reduction of the vacuum is effectuated and thereby by means of the spring element 102 the pipetting position is established.

In FIG. 5 an example of the holding apparatus 200 according to the present invention is displayed, which is a modular component. The modular holding apparatus can be operated independently of a pipetting apparatus. For the intended use it is connected with an appropriate pipetting apparatus, as will be explained below in relation to FIG. 6. The essential components of the holding apparatus from FIG. 2*a* are integrated into the holding apparatus in FIG. 5, that have already been expounded in relation to FIG. 2*a*—the pipetting position that is not shown in FIG. 5 would thus correspond to the FIG. 2*b*. A repetition is therefore avoided. The labels in FIG. 5 are named in analogy to the FIGS. 2*a*/2*b*, in which each first cipher "1" of the labels in FIG. 2*a* was replaced by a first cipher "2" of the labels in FIG. 5. As an example, the connecting section 201 corresponds to the connecting section 101 etc.

The modular component 200 can be connected by the user to the pipetting apparatus—and be released from it again—, by connecting it via an attachment connector 220, that comprises for example a thread or a lock device, with a matching complimentary attachment connector of a pipetting apparatus. The holding apparatus comprises an individual case 210 that serves as base part, in which all further constituents of the holding apparatus are arranged resp. fixed. The pipetting channel of the pipetting apparatus can, in this embodiment, be connected fluidicly with the pipetting channel 230 of the holding apparatus, resp. the acceptance compartment 204 of the holding apparatus. The fluidic connection of the two pipetting channel is realized in a fluidic tight way by means of a seal device, so that no leak exists between the pipetting channels, which would alter the pressure applied by the pipetting apparatus in the pipetting channel 230. In FIG. 5 a hollow body 216 of an elastomeric material is provided as seal device, e.g. silicone, through which the pipetting channel extends such that it merges with the acceptance compartment 204 of the holding apparatus at the one (lower) end and that it is open at the other end, in order to be connected to the pipetting channel of the pipetting apparatus. Here, the hollow body is a part of the shape of a hollow cylinder, the lower end of which is connected, in particular glued, in a fluid-tight way with the upper end 203*c*.1 of the membrane element 203*cc* and/or the upper end of the connecting section 201. The upper end of the silicon hollow body 216 extends over the edge of the thread 220, in order to be compressed in axial direction when the pipetting apparatus and the holding apparatus are connected and to so serve as a sealing element.

The modular component comprises preferably a filter element 218 that is arranged between the pipetting channel 230 and the pipetting channel of the pipetting apparatus, when the modular component 200 is connected with the pipetting apparatus. The filter element is permeable to air and impermeable to liquids. This allows for the pipetting (aspiration, extrusion, resp. pressure equalization) between the mentioned pipetting channels during pipetting and prevents that a liquid is aspirated into the pipetting apparatus or flows into it in case the user accidentally aspirates a too big volume or rotates the pipetting apparatus with a filled pipette accidentally further than the horizontal orientation. Here, the filter element 218 is a porous, cylindrical part that is inserted into the pipetting channel, resp. into a channel formed by the seal device 216 in such a way that a liquid that has reached in a case of error the acceptance compartment 204 resp. the section of the pipette that is mounted there cannot bypass between the filter element and the inner wall of the seal device 216. As soon as the filter element is impregnated with a liquid, the filter element becomes impermeable to air and a further pipetting of air resp. the liquid is impeded, the pipetting channel is locked and the filter element thus protects the valve device and the pump of the pipetting apparatus. The continued use of the pipetting system is possibly only after the exchange of the filter element 218.

The filter element is a disposable item. It consists preferably of a hydrophobic filter material, in particular of hydrophobic polytetrafluoroethylene (PTFE) or comprises such material. Steam or moisture do not wet such material.

In a modular embodiment, the operating element 213 for operating the clamping connection device is part of the modular component, in particular—operable by the user—integrated into the case 210 of the holding apparatus. The holding apparatus 200 comprises an electronic control device that is configured to control the pump 214, in particular in function of control parameters that are affected by the control device, by the means of which the user activates the pump in order to open the clamping connection (acceptance position, corresponding to FIG. 2*a*, 5) and by the means of which the user activates the clamping connection by the deactivation of the pump (pipetting position, corresponding to FIG. 2*b*). The electronic control device comprises at least one switch for closing resp. opening an electric contact, but it can also comprise an electronic circuit. In particular the electronic control device can comprise a battery management system, by which the charging of a, in this case, rechargeable battery 215 is controlled.

The holding apparatus comprises an individual pumping device 214 for the generation of the pipetting pressure in the aspiration channel 203 of the holding apparatus that is connected fluidicly with the air chamber 203*a* of the holding apparatus and by which the partial vacuum that is effective in the air chamber device can be applied. The pumping device is powered by a battery 215, that is also part of the holding apparatus 200. In this way, the clamping connection device, resp. the holding apparatus 200 is a self-contained operable device, that is a device that can operate without the support of a pipetting apparatus or another device.

In the case of the modular implementation of the holding apparatus 200, the invention relates in particular to the system 400 displayed in FIG. 6, that a) comprises a pipetting apparatus 300 for pipetting a liquid sample (9*a*) by aspiration into a pipetting container (9) by means of air under the pipetting pressure and b) a holding apparatus that can be optionally connected to the pipetting apparatus and be released again;

c) optionally: and adapter for connecting the holding apparatus with the pipetting apparatus.

The pipetting apparatus comprises a connecting section 320 that is complementary to the connecting section 220 of the holding apparatus 200, that is thus configured to be connected with the latter, so that the holding apparatus 200 is firmly connected with the pipetting apparatus and the pipetting channel of the pipetting apparatus is connected in a fluid-tight way with the pipetting channel 230 of the holding apparatus. In the case that the pipetting apparatus 300 does not comprise a complementary connecting section: The connecting section 320 can also be part of a specific adapter for the pipetting apparatus 300, which can be connected with a specific connecting section of the pipetting apparatus 300, in order to facilitate the attachment of the holding apparatus 200 via the connecting sections 220, 320.

The invention claimed is:

1. Holding apparatus (5; 50; 50'; 100) for holding a pipetting container (9; 9'), at a pipetting apparatus (1), comprising a tubular connecting section (51; 51'; 101), that is configured to hold a tubular end (9*d*) of the pipetting container (9; 9') in a pipetting position with a clamping connection, the pipetting position allowing pipetting of a liquid into the pipetting container by means of the pipetting apparatus, a clamping connection device (102; 103), which is arranged at the connecting section and which comprises a spring device (102) for the establishment of the clamping connection, and an air chamber device (103) for releasing the clamping connection, wherein the spring device (102) is configured to exert a spring force (F), by way of which the tubular end of the pipetting container is held at the connecting section in the pipetting position, wherein the spring device (102) comprises a spring element, which effectuates said spring force and which is arranged in an air chamber of the air chamber device, and the air chamber device (103) is configured to be deformed in the pipetting position by a partial vacuum applied to the air chamber, thereby the spring device being elastically deformed such that the clamping connection being released.

2. Holding apparatus according to claim 1, wherein the connecting section (101) comprises an inner compartment (54; 104) and is configured to accommodate in an acceptance position of the clamping connection device in the inner compartment (54; 104) the tubular end of the pipetting container.

3. Holding apparatus according to claim 1, comprising the pipetting container, wherein the tubular connecting section of the holding apparatus is configured to engage the tubular end of the pipetting container in an acceptance position, wherein the tubular connecting section features an outer diameter that is smaller than an inner diameter of the tubular end of the pipetting container.

4. Holding apparatus according to claim 1, wherein the air chamber device (103) comprises an elastically deformable membrane element (103*c*).

5. Holding apparatus according to claim 4, wherein the membrane element (103*c*) is part of the air chamber (103*a*) of the air chamber device or establishes the air chamber (103*a*).

6. Holding apparatus according to claim 5, wherein the air chamber (103*a*) is tubular and arranged coaxially with the connecting section (101).

7. Holding apparatus according to claim 4, wherein the air chamber device comprises a connection (103*b*), with which the partial vacuum can be applied in the air chamber device and the clamping connection device is configured such that a deflection (B) of the membrane element, which strains the spring device by its elastic deformation, can be generated by the partial vacuum.

8. Holding apparatus according to claim 1, wherein the spring device comprises a polymeric foam piece, which acts as a spring element.

9. Holding apparatus according to the claim 8, wherein the foam piece is of tubular shape and the air chamber is configured for the acceptance of the foam piece.

10. Holding apparatus according to claim 8, wherein the foam piece consists of an open-pore polymer foam.

11. Holding apparatus according to claim 10, wherein the open-pore polymer foam is a polyurethane foam.

12. Holding apparatus according to claim 1, wherein, in an acceptance position, in which the tubular end can be connected with the connecting section, the spring element is under tension and is compressed, wherein the spring element is less compressed in the pipetting position, in which the pipetting container is slipped onto the connecting section, than in the acceptance position.

13. Pipetting apparatus (1) for the pipetting of a fluid sample (9*a*) by aspiration into a pipetting container (9) by means of air under a pipetting pressure (9*b*), that comprises a holding apparatus according to one of the preceding claims.

14. Pipetting apparatus according to claim 13, wherein either a) the holding apparatus is a permanent component of the pipetting apparatus, or b) the holding apparatus is a modular component of the pipetting apparatus and that can be removed from it again.

15. Pipetting apparatus according to claim 13 further comprising a pumping device (7) for generating the pipetting pressure in a pipetting channel (21), which extends through a case of the pipetting apparatus into the connecting section of the holding apparatus, wherein the air chamber device of the holding apparatus is connected to an aspiration channel (22) in the pipetting apparatus, wherein the partial vacuum, which is effective in the air chamber device, can be applied to the aspiration channel, wherein the pipetting apparatus comprises a valve device (31; 32), with which either a fluidic connection of an aspiration inlet of the pumping device with the pipetting channel (21) or a fluidic connection of the aspiration inlet of the pumping device with the aspiration channel (22) is established.

16. Pipetting apparatus according to claim 15, further comprising an electronic control device (8), at least one operating element (11; 12) for activating and/or deactivating the pipetting of the fluid sample by aspiration into the pipetting container and at least one operating part (15) for releasing the clamping connection of the pipetting container with the holding apparatus, wherein the control device is configured for the control of the pumping device (7) and of the valve device (31; 32).

17. Pipetting apparatus according to claim 16, wherein the control device (8) is configured such that the fluidic connection between the pumping device (7) and the pipetting channel (21) is closed, if the fluidic connection between the pumping device (7) and the aspiration channel (22) is open and the pumping device is activated, and such that the fluidic connection between the pumping device (7) and the aspiration channel (22) is closed if the fluidic connection between the pumping device (7) and the pipetting channel (21) is open and the pumping device is activated.

18. Holding apparatus according to claim 1, wherein the pipetting container is a serological pipette.

* * * * *